US006519851B2

(12) United States Patent
Bonny et al.

(10) Patent No.: US 6,519,851 B2
(45) Date of Patent: Feb. 18, 2003

(54) AIR GAP INSULATED EXHAUST PIPE WITH BRANCH PIPE STUB AND METHOD OF MANUFACTURING SAME

(75) Inventors: Pierre Bonny, Hamburg (DE); Thomas Huelsberg, Rosengarten (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/957,540

(22) Filed: Sep. 21, 2001

(65) Prior Publication Data

US 2002/0014007 A1 Feb. 7, 2002

Related U.S. Application Data

(62) Division of application No. 09/201,134, filed on Nov. 30, 1998, now Pat. No. 6,349,468.

(30) Foreign Application Priority Data

Nov. 28, 1997 (DE) ..... 197 52 772

(51) Int. Cl.[7] ..... B23P 15/00
(52) U.S. Cl. ..... 29/890.08; 29/523; 29/421.1
(58) Field of Search ..... 29/890.08, 523, 29/421.1; 60/323

(56) References Cited

U.S. PATENT DOCUMENTS 4,840,053 A * 6/1989 Nakamura ..... 29/421.1
4,928,509 A * 5/1990 Nakamura ..... 29/421.1

(List continued on next page.)

FOREIGN PATENT DOCUMENTS

DE 41 03 083 5/1992
DE 43 39 290 5/1995

(List continued on next page.)

OTHER PUBLICATIONS

Opposition in a proceeding with the German Patent Office re German Patent Application No. DE 197 52 772.8–13 (English translation).
Response to Opposition to German Patent Document No. DE 197 52 772.8–13 (German language original with English translation).
Opposition in a proceeding with the German Patent Office re German Patent Application No. DE 197 52 773.6–13 (German language original with English translation).
Response to Opposition to German Patent Document No. DE 197 52 773.6–13 (German language original with English translation).

*Primary Examiner*—I. Cuda-Rosenbaum
(74) *Attorney, Agent, or Firm*—Crowell & Moring LLP

(57) ABSTRACT

A method for manufacturing an air-gap-insulated exhaust pipe having a branch stub, as well as an exhaust pipe produced according to such a method and a tool for forming such an exhaust pipe. Two tubes are inserted into one another to form a double tube. The double tube is placed in a first internal high-pressure shaping tool, and exposed to internal high pressure fluid such that it expands to match the contours of the engraving of the first shaping tool, and a double-walled branch stub is blown out of the double tube. The partially formed double tube is then placed in a second internal high-pressure shaping tool, with the double tube being surrounded, between the two ends including the branch stub, circumferentially and throughout by a corresponding design of the engraving, by an expansion chamber. The outer tube is expanded between the outer tube and inner tube under high pressure up to a precise fit with the engraving of the second shaping tool to form an insulating air gap, with the end of the branch stub being supported externally without yielding via a second counterpunch. The finished double tube is removed from the second shaping tool and a cap area of the branch stub, containing the end, is cut off to form a through opening between the interior of the inner tube and the ambient environment outside the air-gap-insulated exhaust pipe.

10 Claims, 5 Drawing Sheets

U.S. PATENT DOCUMENTS

| | | | | | |
|---|---|---|---|---|---|
| 5,170,557 | A | * | 12/1992 | Rigsby | 138/148 |
| 5,189,790 | A | * | 3/1993 | Streubel et al. | 29/424 |
| 5,363,544 | A | * | 11/1994 | Wells et al. | 138/114 |
| 5,390,494 | A | * | 2/1995 | Clegg | 29/890.08 |
| 5,475,911 | A | | 12/1995 | Wells et al. | 29/33 |
| 5,582,052 | A | | 12/1996 | Rigsby | 72/62 |
| 5,600,983 | A | | 2/1997 | Rigsby | 72/61 |
| 5,673,470 | A | | 10/1997 | Dehlinger et al. | 29/421.1 |
| 5,682,741 | A | | 11/1997 | Augustin et al. | 60/323 |
| 5,697,155 | A | | 12/1997 | Bloecker et al. | 29/890.148 |
| 5,799,395 | A | * | 9/1998 | Nording et al. | 29/890.08 |
| 5,836,065 | A | | 11/1998 | Dehlinger et al. | 29/33 |

FOREIGN PATENT DOCUMENTS

| | | |
|---|---|---|
| DE | 44 28 435 | 2/1996 |
| DE | 195 11 514 | 8/1996 |
| DE | 195 18 252 | 11/1996 |
| DE | 195 46 509 | 6/1997 |
| EP | 0 582 985 | 2/1994 |
| EP | 0 623 739 | 11/1994 |
| EP | 0 761 335 | 3/1997 |
| WO | 95/31635 | 11/1995 |

* cited by examiner

AIR GAP INSULATED EXHAUST PIPE WITH BRANCH PIPE STUB AND METHOD OF MANUFACTURING SAME

This application is a division of application Ser. No. 09/201,134, filed Nov. 30, 1998 now U.S. Pat. No. 6,349, 468.

This application claims the priority of German application 197 52 772.8, filed Nov. 28, 1997, the disclosure(s) of which is (are) expressly incorporated by reference herein.

BACKGROUND AND SUMMARY OF THE INVENTION

The invention relates to an air gap insulated exhaust pipe with branch pipe stub and method of manufacturing same.

A method for manufacturing an exhaust pipe is known from German patent document DE 195 11 514 C1. This document teaches the manufacture of an exhaust pipe, insulated by an air gap, and provided with a branch stub in conjunction with a combination of several exhaust pipes to form an exhaust manifold with the outer jacket of the branched exhaust pipe consisting of two half-shells connected with one another being a common component of all the exhaust pipes of the exhaust manifold. Thus, the inner tubes of the exhaust pipes are initially pushed onto one another with a push fit and provided in a costly fashion with special spacing rings which later evaporate after assembly during the operation of the exhaust system. The plug connection is then inserted into a lower shell of the outer jacket and positioned in an awkward fashion. Since the individual tubes which are subject to manufacturing tolerances are displaceable with respect to one another and have different insertion lengths from one plug-in connection to the next plug-in connection because of the assembly work, and the spacing rings are themselves subject to manufacturing tolerances and also, because of their design relative to the shape of the lower shells, rarely abut the latter circumferentially, the manufacture of the entire exhaust manifold is subject to tolerances due to these factors alone. There is no such thing as exact reproducibility.

It is important to observe during assembly that a certain minimum insertion length is maintained so that the individual internal tubes do not slide apart. This retention requires visual estimation and hence considerable effort. During the transfer of the parts to the welding station, vibrations and centrifugal forces can likewise occur that can lead to additional displacement of the individual inner tubes with respect to one another and with respect to the lower shell of the outer jacket, which can lead to the plug-in connection coming apart. The transposition of the troublesome positioning of the inner tubes in the lower shell of the outer jacket by means of the spacing rings and the tolerances resulting from manufacturing technology in the design of the inner tubes as well as the different associated relative positions of the inner tube inside and outside the outer jacket to the outer jacket, an individual branched inner tube with an outer jacket consisting of two half-shells can be produced in simple fashion. The inner tube with the branched stub with the stated manufacturing tolerances is never located inside the outer jacket with the desired defined circumferential air gap.

Due to the delayed rebound of the two sheet-metal half-shells following deep drawing, the two half-shells do not abut one another continuously tightly and thus gap-free. Therefore, in the welding station, the upper shell of the outer jacket is placed on the lower shell and pressed against the latter. In this situation as well, there are vibrations of the plug-in connection and/or displacement of the relative position of the branched inner tube in the outer jacket. Finally, the shells of the outer jacket are laser-welded to one another. After the pressure is relieved, because of the nonuniformity of the contact surfaces of the half-shells, considerable tensile forces act on the welded seam, which reduces the long-term load-carrying capacity of the assembly, especially of the outer jacket, and can result in failure of the part during operation of the exhaust line.

In addition, the welding of the half-shells to form a crimped seam is relatively awkward, especially since at the transition to the cutout in the outer jacket for the branch stub of the inner tube, because of the edge radii, a triangular gore results which must be welded for processing safety, which in practice logically takes place only with the assistance of an additional material. In addition, the crimped seam can also be subjected only to limited mechanical loading due to its design. To secure the inner tube to the outer jacket, a weld is also required that forms a round seam, in other words, a circumferential hollow weld in the end area of the branch stub, with the end of the inner tube of the stub being slightly recessed relative to the opening of the outer jacket. The outer jacket is also designed to project considerably into space because of the branched exhaust pipe, which, during the manufacture of the half-shells by deep-drawing, cannot achieve branching and thus is not suitable for a defined formation of an outer jacket relative to the design of the inner tube. However, this requires considerable space and increases the weight of the branched exhaust pipe. In addition, the design of a defined, uniformly constant air gap with a branched exhaust pipe cannot be achieved by this design.

A goal of the invention is to improve on a method of manufacturing an exhaust pipe that an air-gap-insulated exhaust pipe with a branch stub can be manufactured exactly reproducibly in simple fashion, and which can easily be built up without adversely affecting the dimensional accuracy of the width of the air gap and the position of the inner tube relative to the outer jacket.

This and other goals have been achieved according to the present invention by providing a method for producing an air-gap-insulated exhaust pipe with a branch stub for a vehicle exhaust line having an inner tube with a branch for carrying exhaust surrounded at a distance by an outer jacket to form an insulating air gap, said method comprising: providing two tubes having a corresponding shape, inserting said tubes into one another with limited play to form a double tube, placing said double tube in a first internal high-pressure shaping tool having a first engraving including a branch, sealing off both ends of said double tube to be tight to a high-pressure fluid, closing the first shaping tool and introducing a pressure fluid into an interior of the inner tube of the double tube such that the double tube expands to match the contours of the first engraving to form a shaped double tube including a double-walled branch stub blown out of the double tube into the branch, relieving the pressure fluid in the first shaping tool, removing the shaped double tube from the first shaping tool, placing the shaped double tube in a second internal high-pressure shaping tool having a second engraving which holds the shaped double tube at axial end areas in a fit with play, the second engraving being spaced apart from the shaped double tube between the axial end areas including the branch stub to define an expansion chamber, closing the second shaping tool and introducing a pressure fluid between the two tubes that form the shaped double tube and simultaneously into the interior of the inner tube, such that the outer tube expands into said expansion chamber and engages said second engraving of the second shaping tool to define an insulating air gap between the outer tube and the inner tube, an end of the branch stub facing away from the rest of the double tube being externally supported without yielding via a second tool counterpunch located in a branch of said second engraving, relieving the pressure fluid in the second shaping tool, removing the finished double tube from the second shaping tool, and cutting off a cap area at the end of the branch stub to form a through opening between the interior of the inner tube and the outside of the air-gap-insulated exhaust pipe.

This and other goals have been achieved according to the present invention by providing a method for producing an air-gap-insulated exhaust pipe with a branch by internal high-pressure forming, said method comprising: placing an inner tube inside of an outer tube to form a double tube; placing said double tube in a first internal high-pressure shaping tool having a first engraving including a branch; forming an intermediate shaped double tube by introducing a pressure fluid into an interior of the inner tube such that the double tube expands into the branch; arranging the intermediate shaped double tube in a second internal high-pressure shaping tool having a second engraving which is circumferentially larger than said first engraving such that an exterior of said shaped double tube is spaced apart from said second engraving to define an expansion chamber therebetween; forming a final shaped double tube by introducing a pressure fluid between the two tubes and simultaneously into the interior of the inner tube, such that the outer tube expands into said expansion chamber into engagement with said second engraving of the second shaping tool to form an insulating air gap between the outer tube and the inner tube.

This and other goals have been achieved according to the present invention by providing a tool system for producing an air-gap-insulated exhaust pipe with a branch by internal high-pressure forming a double tube including an inner tube nested inside of an outer tube, said tool system comprising: a first internal high-pressure shaping tool having a first engraving including a main receiving area for receiving said double tube and a branch extending radially from said main receiving area for supporting a portion of the double tube to be expanded into the branch under high-pressure forming; a second internal high-pressure shaping tool having a second engraving which is circumferentially larger than said first engraving.

According to the invention, a simple manufacture of the branched exhaust pipe is possible from two welded or drawn double tubes that are pushed into one another, prefabricated by cutting or bending. There is no costly deep-drawing of the half shells that form the outer jacket or any very complicated welding of the two half-shells, especially at the transition between the crimped seam and the round seam in the vicinity of the branched stub, at which transition a gore results because of the edge radii, which can be welded shut with additional material to ensure the long-term load-carrying capacity of the welded seam. Moreover, no assembly-intensive error- and tolerance-prone assembly of the exhaust pipe is necessary, but the relative positions of the two tubes pushed into one another is determined after initial shaping by endwise clamping of the tubes to one another. No spacing rings are required because there is no insulating air gap due to the suitable assembly of the inside tube in the outside jacket; rather the gap is created automatically by the second shaping of the double tube. As a result of the established nondisplaceable relative positions of the two tubes following the first shaping relative to one another and the dependencies of the insulating air gap widths only on the shape of the engraving and the completeness of the shaping, both of which can be readily controlled, a constant gap width is ensured in simple fashion.

Since the branch stub is made of a double-walled tube consisting of an inner tube and an outer tube—the later outer jacket—during the first internal high-pressure shaping process, the outer tube adjusts as a function of the method with proper contours to the inside tube. As a result, with a branched exhaust pipe and thus with the entire exhaust line, by contrast to deep-drawn half-shells, space, material, and weight are saved. Because of the matching of the contours of the outer tube, the length of the branched stub can be made relatively short so that when the branched exhaust pipe is connected to additional exhaust line parts in the vicinity of the branched stub, a compacting process, in other words, a gain in space for this assembly, can be achieved.

In addition, the branched exhaust pipe according to the invention can withstand permanent loads better than the conventional solutions, since the exhaust pipe contains welded seams only at the connecting points to other parts of the exhaust line during the connecting process, which welded seams can be made in simple fashion in the shape of circumferential hollow welds that can withstand high mechanical loads. The crimped seams that are prone to failure in known exhaust pipes are eliminated.

Finally, as a result of the freedom from tolerance that is linked to the method of internal high-pressure shaping, exact reproducibility of the branched exhaust pipe is made possible and hence it is easier to automate exhaust pipe manufacture without finishing work for improvement. Because of the clamping of the individual tube walls at both ends of the exhaust pipe, the exhaust pipe can be readily coupled there to other parts without the relative position of the inner tube with respect to the outer tube and the gap width changing. At the end of the branch stub, the inner tube, if desired, can be pushed in simple fashion onto another inner tube of another air-gap-insulated exhaust pipe and remain there in a slide fit while the outer tubes of the two exhaust pipes are welded to one another forming a simple circumferential hollow weld. The exhaust pipe according to the invention is thus easily installed on other parts of the exhaust line because of its space advantages and its problem-free and reliable as well as rapid connection.

Other objects, advantages and novel features of the present invention will become apparent from the following detailed description of the invention when considered in conjunction with the accompanying drawings.

BRIEF DESCRIPTION OF THE DRAWINGS

FIG. 5 is a perspective view of an end section of the double tube in FIG. 4 with the cut strip of the outer tube after the inner tube is cut through;

DETAILED DESCRIPTION OF THE DRAWINGS

Figure 1:
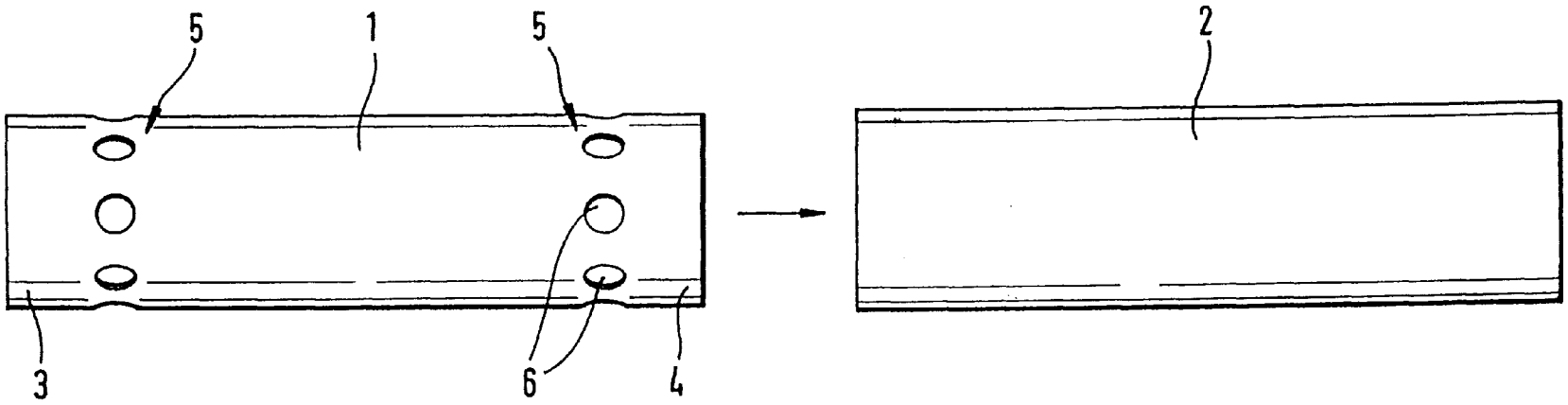
FIG. 1 shows in a side view a first step in the method according to a preferred embodiment of the present invention during the insertion of two tubes into one another, with the inner tube being perforated.

In FIG. 1, two tubes of equal length that extend in a straight line with approximately circular cross sections are shown, with one tube, inner tube 1, being inserted in the direction of the arrow into the other tube, outer tube 2, with complete coverage of inner tube 1 with a small amount of play. Inner tube 1 at its two ends 3, 4 has a hole circle 5 with through holes 6 uniformly distributed around the circumference at its two ends 3, 4. The two tubes 1 and 2 can also be bent and can have a cross section that differs from a circular cross section, but they must be configured to be insertable into one another.

Figure 2:
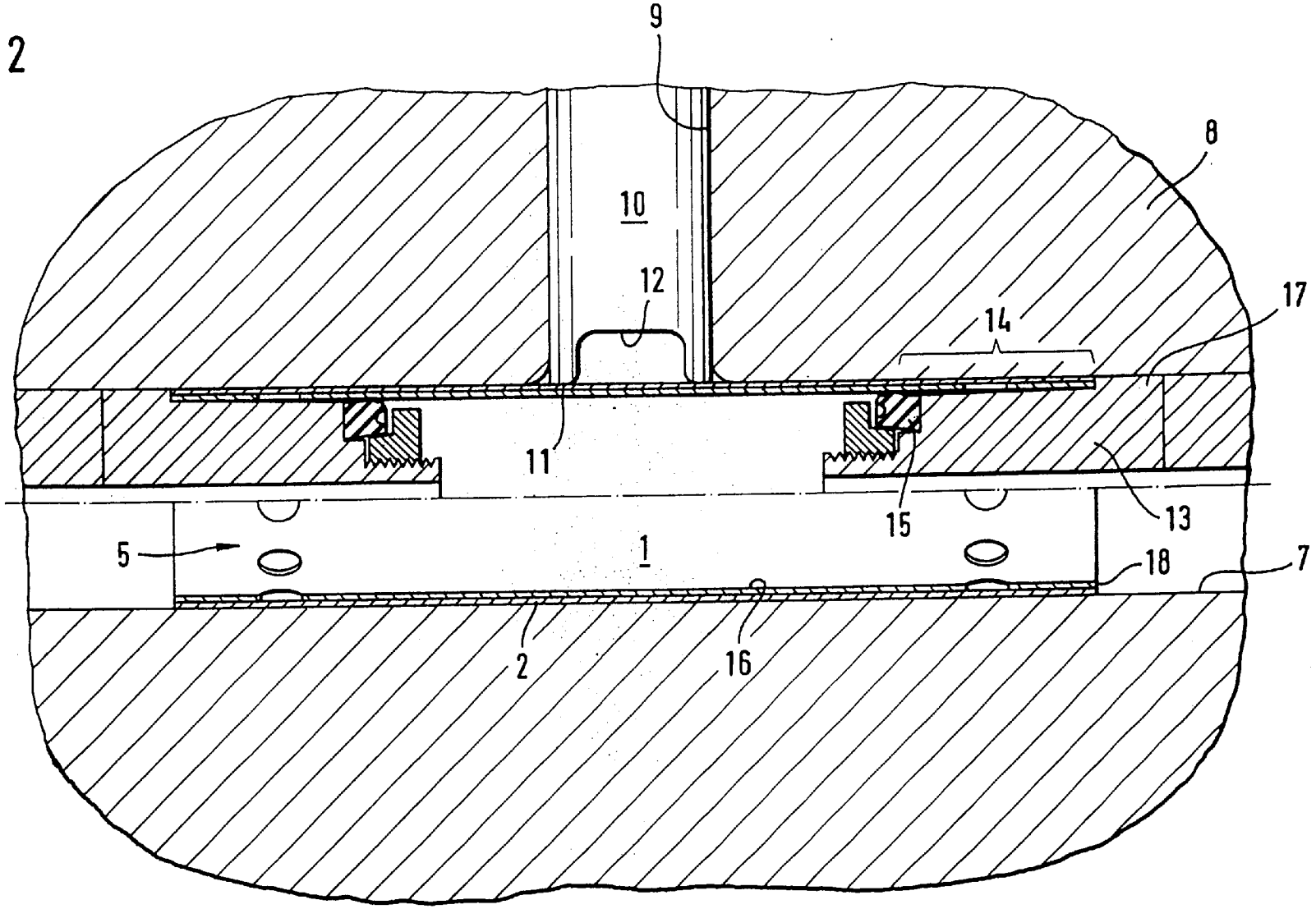
FIG. 2 shows in a lateral lengthwise section the plug-in connection of FIG. 1 in a first internal high-pressure shaping tool, with the double tube and the perforation of the inner tube being sealed off, prior to shaping in the relaxed pressure state of the pressure fluid conducted into the inner tube.

Following the formation of a plug connection of the two tubes 1 and 2, these tubes are inserted as a double tube into an engraving 7 (i.e., a cavity) of a first internal high-pressure shaping tool 8 according to FIG. 2. The shaping tool 8 has a radial branch 9 from the engraving 7 in which a counterpunch 10 is guided. End 11 of counterpunch 10, which has a recess 12 located centrally, is flush with engraving 7 and matches the contours thereof before the first shaping of the double tube. For shaping, the double tube is sealed off at both ends by two sealing heads 13 that are inserted into the ends of the double tube and each is rigidly connected with an axial punch. Sealing head 13 with a section 14 that tapers conically in the insertion direction projects into the double tube for a distance such that the hole circle 5 of inner tube 1 is covered. The conical section 14 of sealing head 13, on the side of hole circle 5 facing the radial branch, has a radially spreadable sealing element 15, for example an elastic O-ring that is pressed against the inside 16 of inner tube 1 for sealing with high force and tight against high fluid pressure. On the side of hole circle 5 that faces away from the radial branch, the circumference of the conical section 14 is greater than the internal circumference of inner tube 1 so that the double tube at this point, when sealing head 13 is inserted, is upset radially forming a radially acting metal seal for the double tube. At the same time, as a result, inner tube 1 is clamped and/or pressed against outer tube 2 establishing their relative positions with respect to one another. Sealing head 13 on the end of the conical section 14 that faces away from the radial branch has an annular bead 17 which, in the operating position of sealing head 13, abuts the end 18 of the double tube, creating an axial seal for the double tube.

Figure 3:
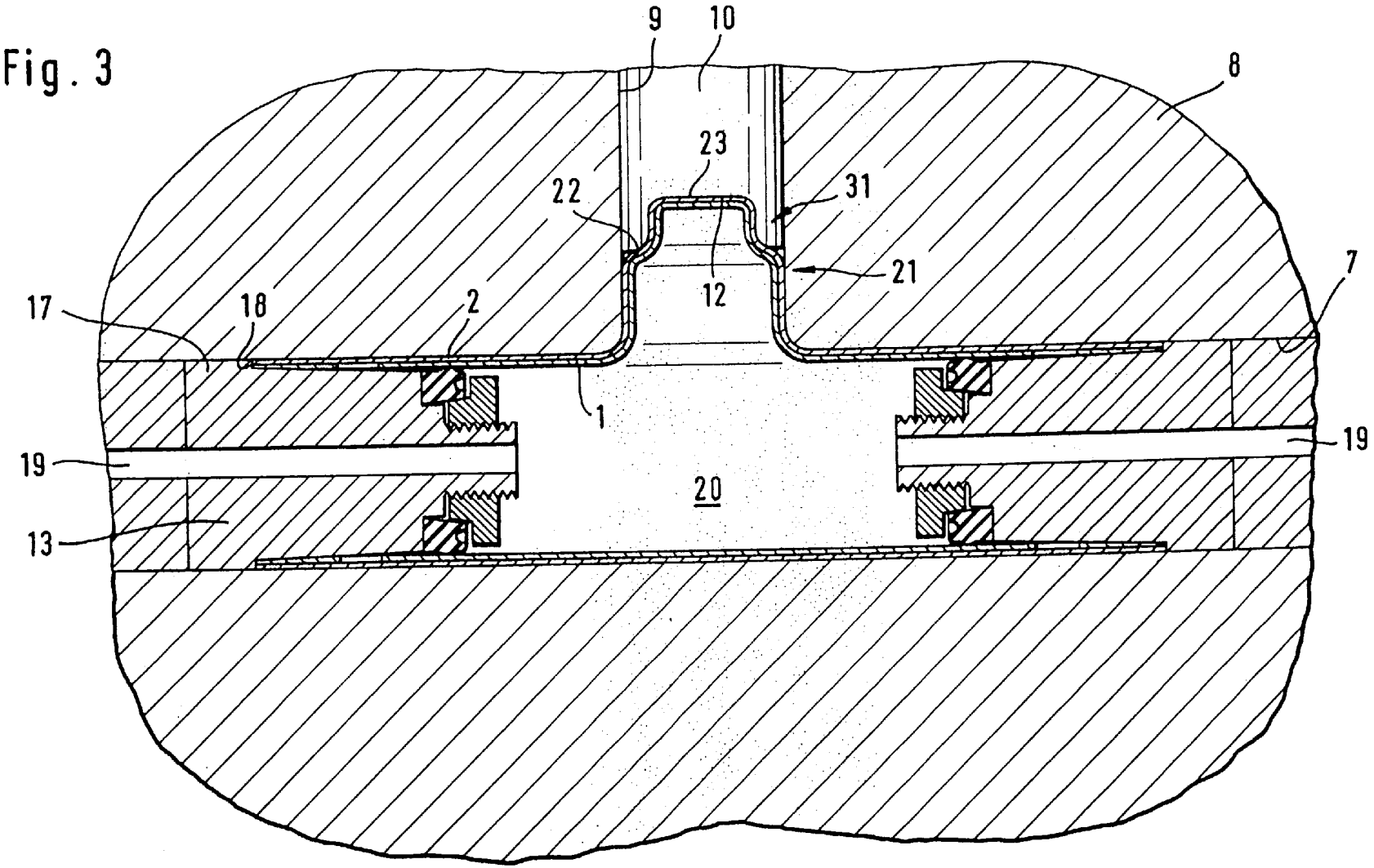
FIG. 3 shows a lateral lengthwise section of the double tube in the shaping tool of FIG. 2, in which under internal high pressure a branched stub with a bottleneck-shaped end is formed.

Referring to FIG. 3, following closing of the first internal high-pressure shaping tool 8, a pressure fluid is conducted through a pressure fluid channel 19 that runs in the axial punch and in the corresponding sealing head 13 into the interior 20 of inner tube 1 and is subjected to high pressure. As shown in FIG. 3, the double tube expands, whereupon the double-walled tube material is forced into recess 12 of the first counterpunch 10. At the same time, or subsequently, the first counterpunch 10 deflects outward under control of a controllable hydraulic cylinder, whereupon, due to the internal high pressure, a double-walled branch stub 21 is blown radially out of the double tube, said stub being supported endwise by the first counterpunch 10 and conforming shapewise laterally to the wall of branch 9. The counterpunch 10 ensures reliable formation of branch stub 21 whereby in addition, because of the force of counterpunch 10 that builds up and opposes the internal high pressure, the tube material of the double tube is pressed against the branch wall, which results in shaping of branch stub 21 with a high external contour quality corresponding to first engraving 7. As a result, a defined reproducible connection to other parts of the exhaust line is achieved.

Because of the central recess (12 formed in the first counterpunch 10, the end 22 of double-walled branch stub 21 bulges like the neck of a bottle due to the internal high pressure. As a result of this bulge 31 of end 22, radial clamping of the walls of inner tube 1 and outer tube 2 is achieved at that point, namely at the end of branch stub 21, whereupon, despite later cutting of the cap area 23 of end 22 of branch stub 21, the position of inner tube 1 with respect to outer tube 2 is established by clamping, even if the ends of the double tube are already cut. Thus the uniformity of the gap width of the insulating air gap later produced is ensured. If a permanent connection of branch stub 21 with another part of the exhaust line is to be produced, the formation of end 22 following cutting favors simple assembly of the air-gap-insulated exhaust pipe by the flush nature of the tube walls that abut one another.

Safety in the first shaping process is assisted considerably by a sufficient supply of tube material. By introducing an axial force into the ends of the tubes of the double tube by way of the axial punch via the annular bead 17 of sealing heads 13 that abut end 18 of the double tube, tube material of the double tube can be pushed toward radial branch 9, in other words the location of the greatest degree of deformation. With the variably adjustable size of the pushing force as desired, the radial length blown out into radial branch 9 can be varied within certain limits in a manner that is safe for the process, whereby a high degree of adaptability of the exhaust pipe to various prevailing installation space conditions can be achieved. As a result of the advance, no perceptible thinning of the wall thickness can be produced, so that good installation conditions during the connection with another part is ensured. If the tube material is not advanced, it is in any event in the interests of process safety, especially the tightness of the shaping device, unavoidable that the axial punches with the sealing heads must be advanced as a function of the shortening of the double tube that takes place as a result of the formation of branch stub 21.

Following the formation of double-walled branch stub 21 from the originally unbranched double tube by the first internal high-pressure shaping process, the pressure fluid is relieved of pressure and conducted out of the branched double tube, after which the first shaping tool 8 is opened and the branched double tube is removed.

Figure 4:
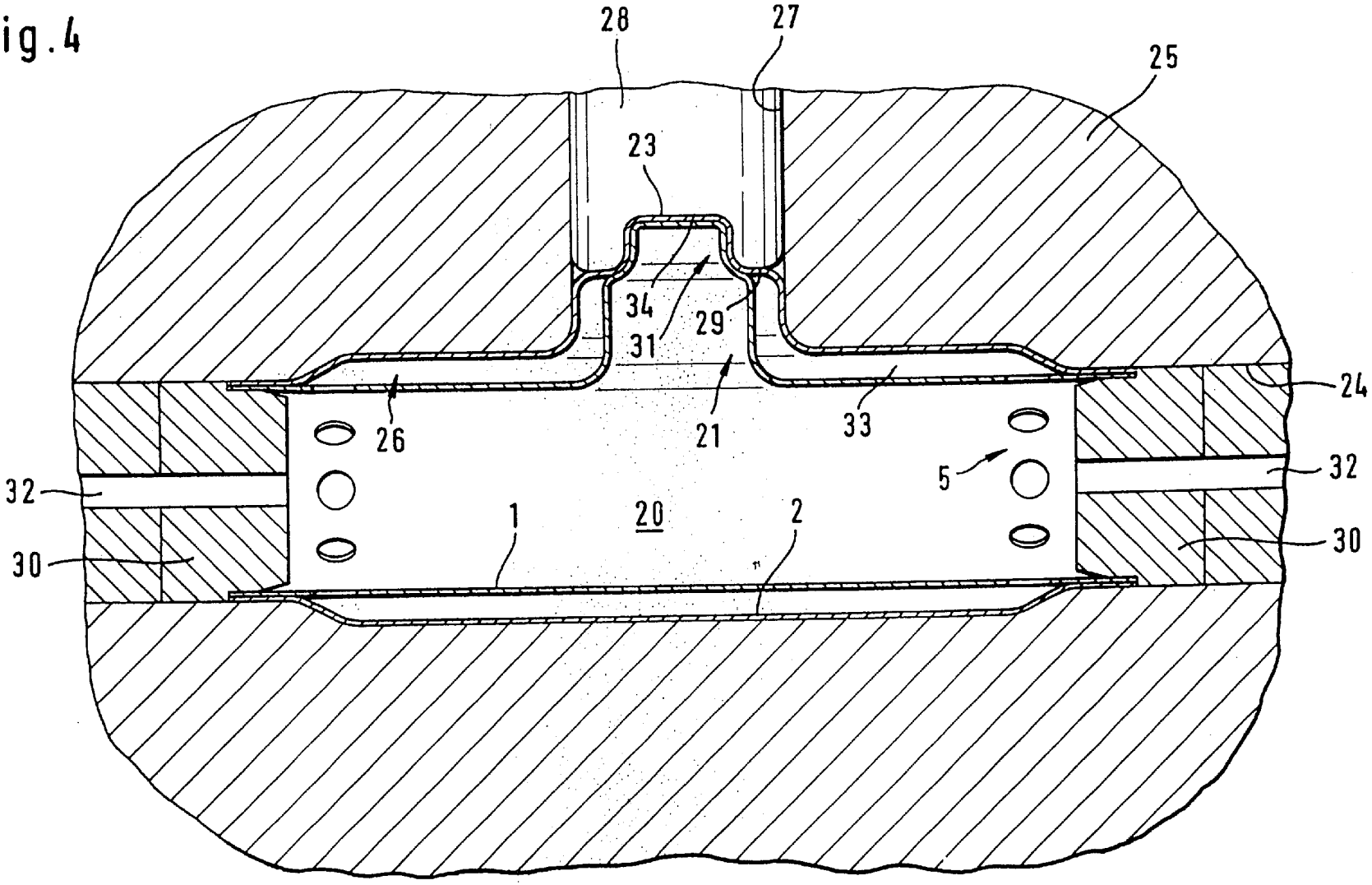
FIG. 4 shows in a lateral lengthwise section the shaped double tube of FIG. 3 in a second internal high-pressure shaping tool following a second shaping under internal high pressure, with the perforation of the inner tube remaining unsealed and an air gap being formed between the inner and outer tubes of the double tube, said gap extending up to the bottleneck of the branch stub.

Referring to FIG. 4, the branched double tube is then placed in engraving 24 of a second internal high-pressure shaping tool 25. Engraving 24 is designed so that the double tube at its end areas is held in a fit with play by engraving 24 and is surrounded between the two ends, circumferentially and throughout, by an essentially cylindrical expansion space 26 coaxial to the double tube. Branch stub 21 is in a branch 27 of engraving 24 which, corresponding to expansion space 26, surrounds branch stub 21 by about the same amount. In branch 27, a second counterpunch 28 is located having a recess 34 formed in its end 29 corresponding to the recess 12 of the first counterpunch 10 of the first shaping tool 8, in which the bottleneck-shaped bulge 31 of branch stub 21 is received with limited play.

For the following second shaping process according to FIG. 4, the second shaping tool 25 is closed and the double tube is sealed again at its two ends by sealing heads 30 of axial punches forming a metal seal and crimping the ends of the tubes, but in such fashion that the hole circle 5 remains freely accessible to exposure to internal high pressure. A pressure fluid is then introduced into interior 20 of inner tube 1 through pressure fluid channels 32 and exposed to high pressure.

Because of the free hole circle 5, outer tube 2 is exposed directly to high pressure, so that it is expanded into expansion chamber 26 and fits with matching contours with the engraving 24 of shaping tool 25 and the wall of branch 27. Counterpunch 28 is supported externally so that it does not yield and thus during the expansion process remains unchanged in its supporting position without expanding radially outward, whereby the non-bulging area of end 22 of branch stub 21 abuts the facing end 29 of counterpunch 28.

As a result of the second shaping of the exhaust pipe, because of the lifting of outer tube 2 from inner tube 1, a gap, the so-called insulating air gap 33 that surrounds the inner tube uniformly between the clamped ends, is created and is made completely constant in terms of its width, so that it exactly follows the contour of inner tube 1 in its path. Inner tube 1, because of the pressure compensation between its interior 20 and gap 33, remains unshaped during the second shaping process.

It is also possible to make inner tube 1 without a hole circle 5 and to introduce the fluid into the separating gap between inner tube 1 and outer tube 2 through the gap with play or through gaps made specially for the purpose on inner tube 1 and leading into the separating gap. However, a pressure chamber connected upstream is required for this purpose, which takes up space and has a more complicated sealing of the double tube. However as a result of hole circle 5 in a highly advantageous manner exposure of outer tube 2 to the internal high pressure is achieved that is easy to produce and immediately covers a large area. In addition, the end areas of the double tube do not undergo any deformation during the introduction of the pressure fluid into the separating gap of the two tubes 1 and 2 from the outside so that the dimensional accuracy of the double tube remains preserved at both ends, which has an especially favorable effect for connection with other parts. Finally the pressure compensation for inner tube 1 is achieved by a simple fluid guidance established in the design of hole circle 5.

Figure 6:
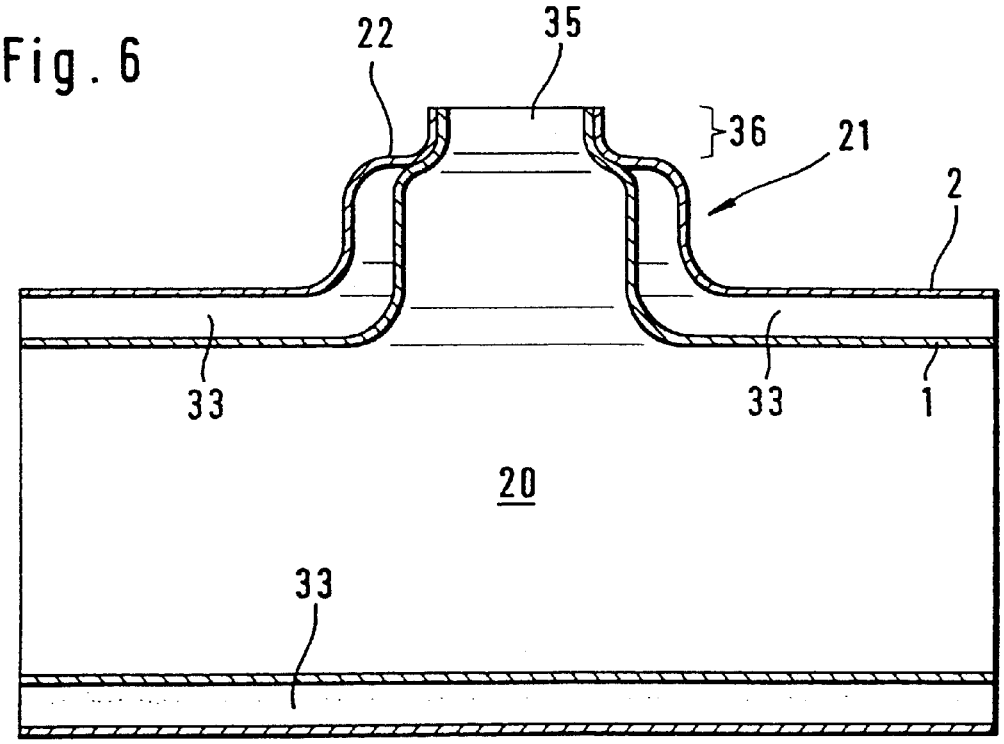
FIG. 6 shows in a lateral lengthwise section the air-gap-insulated exhaust pipe manufactured according to the method steps in FIGS. 1–5 with a branch stub following cutting of the cap of the branch stub.

Following the second shaping, the pressure fluid is relieved of its pressure and brought out of the nearly completely shaped air-gap-insulated exhaust pipe, whereupon the second shaping tool 25 is opened and the exhaust pipe is removed. Thus, with the shaped exhaust pipe clamped in a tool, the cap area 23 of branch stub 21 is cut off by sawing or laser cutting for example, forming a through opening 35 that connects the interior 20 of inner tube 1 with the outer environment of air-gap-insulated exhaust pipe, as shown in FIG. 6. Because of the bottleneck-shaped design of end 22, this leaves a short cylindrical section 36 in which a clamping of the tube walls is still present so that even after the cut is made, no change can take place in the relative position of inner tube 1 relative to outer tube 2.

Finally, the ends of the double tube are optionally cut off while they are being clamped. This takes place when minimization of heat bridges in the connecting area with other exhaust pipes is desired and the connecting area with other exhaust pipes is to be formed relative to outer tube 2 with a simple circumferential hollow weld and relative to inner tube 1 by a sliding fit for compensation of axial thermal expansion and vibrations during the operation of the exhaust system. This connection can be utilized in a highly advantageous manner for assembling an air-gap-insulated exhaust system with other air-gap-insulated exhaust pipes by simply inserting into one another the tubes whose diameters are adjusted to one another at the ends. In particular, the design of the branched exhaust pipe manufactured according to the invention with its endwise cut (FIG. 6) makes possible for the first time a modular design with air-gap-insulated exhaust manifolds, with the branched tube forming a part of the exhaust manifold. The otherwise remaining clamping of the cylindrical portion 36 of end 22 holds tubes 1 and 2 together in the previous position in which they were spaced apart from one another, so that during assembly, position tolerances and nonuniformities of the gaps that occur are avoided. This can also be achieved if end 22 does not have a bulge 31, in other words, after cutting has no cylindrical section 36 and thus no clamping of the walls of tubes 1 and 2. However, after cap area 23 has been cut, branch stub 21 must be secured radially with respect to inner tube 1 and outer tube 2 by connecting the exhaust pipe at the end of branch stub 21 with another part of the exhaust line, for example by welding outer tube 2 with the outer tube of the connecting part and the formation of a sliding seat between inner tube 1 and that of its inner tube, whereupon the exposed end areas of the exhaust pipe are cut off along with the walls of inner tube 1 and of outer tube 2 that are pressed against one another there with a clamping action.

Figure 5:
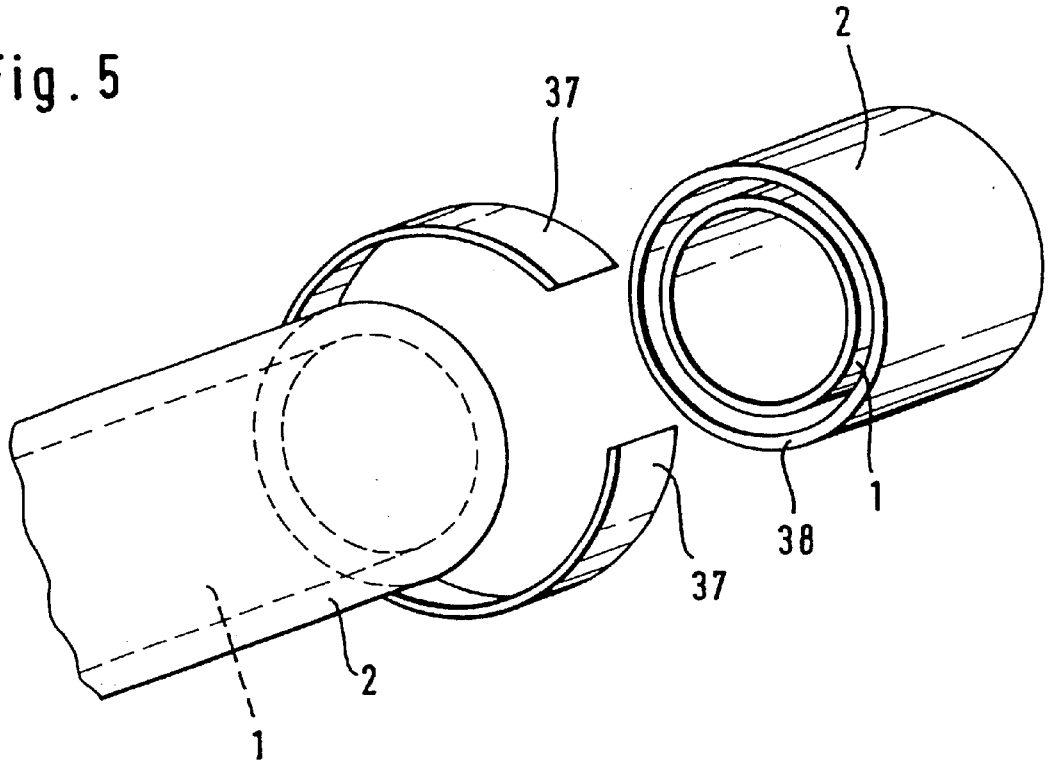

To cut off the tube ends, the latter are subjected at outer tube 2 on the side of the hole circle 5 facing away from the radial branch by a beam-cutting method, preferably a cutting laser. The cutting laser cuts the outer tube forming a slot axially at two points that are diametrically opposite one another on the circumference. Then two circumferential cuts spaced apart from one another are made in the outer tube 2 with the cutting laser, said cuts each passing through one of the end points of the axial slots. The resulting semicircular sheet metal strips 37 of outer tube 2 are separated, so that inner tube 1 is freely accessible (see FIG. 5). Inner tube 1, possibly flush with cutting edge 38 of outer tube 2, can then be separated by sawing or likewise by a beam-cutting method, for example a laser or an electron beam (FIG. 5). Beam cutting of outer tube 2 advantageously produces a generally accurate separation of the ends of the double tube.

Of course it is also possible that after the cap of branch stub 21 is cut off, outer tube 2 and inner tube 1 are open, and the ends of the double tube remain clamped to one another so that, as a result of the clamping at that point, centering of inner tube 1 in outer tube 2 is ensured. A further connection with exhaust pipes at the ends is made by welding with the double wall of the branched tube.

The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. A method for producing an air-gap-insulated exhaust pipe with a branch stub for a vehicle exhaust line having an inner tube with a branch for carrying exhaust surrounded at a distance by an outer jacket to form an insulating air gap, said method comprising:

providing a first tube and a second tube, each having a corresponding shape, inserting said first tube into said second tube with limited play to form a double tube, having an inner tube and a outer tube, placing said double tube in a first internal high-pressure shaping tool having a first engraving including a branch, sealing off both ends of said double tube to be tight to a high-pressure fluid, closing the first shaping tool and introducing a pressure fluid into an interior of the inner tube of the double tube such that the double tube expands to match the contours of the first engraving to form a shaped double tube including a double-walled branch stub blown out of the double tube into the branch, relieving the pressure fluid in the first shaping tool, removing the shaped double tube from the first shaping tool, placing the shaped double tube in a second internal high-pressure shaping tool having a second engraving which holds the shaped double tube at axial end areas in a fit with play, the second engraving being spaced apart from the shaped double tube between the axial end areas including the branch stub to define an expansion chamber, closing the second shaping tool and introducing a pressure fluid between the two tubes that form the shaped double tube and simultaneously into the interior of the inner tube, such that the outer tube expands into said expansion chamber and engages said second engraving of the second shaping tool to define an insulating air gap between the outer tube and the inner tube, an end of the branch stub facing away from the rest of the double tube being externally supported without yielding via a second tool counterpunch located in a branch of said second engraving, relieving the pressure fluid in the second shaping tool, removing the finished double tube from the second shaping tool, and cutting off a cap area at the end of the branch stub to form a through opening between the interior of the inner tube and the outside of the air-gap-insulated exhaust pipe.

2. A method according to claim 1, wherein following a radial securing of inner tube and outer tube in a connection of the exhaust pipe at the end of the branch stub with another part of the exhaust line, exposed end areas of the exhaust pipe together with the walls of the inner tube and the outer tube that are pressed against one another with a clamping action are cut off.

3. A method according to claim 2, wherein the exposed end areas of the exhaust pipe are cut off by cutting circumferential strips on the outer tube all the way around by beam cutting, and the inner tube is then separated by sawing or beam cutting in the area exposed by removal of the circumferential strips.

4. A method according to claim 1, wherein the inner tube is provided with at least one through hole, such that said insulating air gap is formed in the second shaping tool by the pressure fluid being conducted from the interior of the inner tube out through said at least one through hole between the tubes that form the double tube, said at least one through hole being sealed during expansion of the double tube in the first shaping tool.

5. A method according to claim 1, wherein during the first shaping process in the first shaping tool, an end of the double-walled branch stub is supported by a first tool counterpunch that deflects outward and is guided displaceably in said branch of said first engraving.

6. A method according to claim 5, wherein a central recess is formed in said first tool counterpunch, such that during the first shaping process the end of the double-walled branch stub is made to bulge bottleneck-wise by the high pressure fluid.

7. A method according to claim 1, wherein during the first shaping process in the first shaping tool at least one axial punch impacts an axial end of the double tube to advance tube material toward the branch stub.

8. A method for producing an air-gap-insulated exhaust pipe with a branch by internal high-pressure forming, said method comprising:

placing an inner tube inside of an outer tube to form a double tube;

placing said double tube in a first internal high-pressure shaping tool having a first engraving including a branch;

forming an intermediate shaped double tube by introducing a pressure fluid into an interior of the inner tube such that the double tube expands into the branch;

arranging the intermediate shaped double tube in a second internal high-pressure shaping tool having a second engraving which is circumferentially larger than said first engraving such that an exterior of said shaped double tube is spaced apart from said second engraving to define an expansion chamber therebetween;

forming a final shaped double tube by introducing a pressure fluid between the two tubes and simultaneously into the interior of the inner tube, such that the outer tube expands into said expansion chamber into engagement with said second engraving of the second shaping tool to form an insulating air gap between the outer tube and the inner tube.

9. A method according to claim 8, wherein during the step of forming an intermediate shaped double tube, an end of the double tube that expands into the branch is supported by a first tool counterpunch that deflects outward and is guided displaceably in said branch of said first engraving.

10. A method according to claim 9, wherein a central recess is formed in said first tool counterpunch, such that during the step of forming an intermediate shaped double tube, the end of the double tube that expands into the branch is formed into a bottleneck.

* * * * *